US005480146A

United States Patent [19]

Comer

[11] Patent Number: 5,480,146

[45] Date of Patent: Jan. 2, 1996

[54] GOLF GRIP WITH RECESSES TO INSURE PROPER HAND POSITIONING OF A USER

[76] Inventor: Larry D. Comer, 217 Liberty Dr., Thomasville, N.C. 27360

[21] Appl. No.: 352,396

[22] Filed: Dec. 8, 1994

[51] Int. Cl.[6] ..... A63B 53/14

[52] U.S. Cl. ..... 273/81.4; 273/81 B

[58] Field of Search ..... 273/81.4, 81 B, 273/81 R, 165, 75, 67 DB, 187.5, 81.6, 81 D; D21/222

[56] References Cited

U.S. PATENT DOCUMENTS

| | | | |
|---|---|---|---|
| D. 125,602 | 3/1941 | Wheeler | 273/81.4 |
| 1,556,473 | 10/1925 | Ballou | 273/81.4 |
| 1,664,257 | 3/1928 | McCullough | 273/81.4 |
| 1,982,526 | 11/1934 | Lussky | 273/81.4 |
| 2,091,512 | 8/1937 | Marsh | 273/81.4 |
| 2,121,718 | 6/1938 | Sweetland | 273/81.4 |
| 2,628,100 | 2/1953 | Beebe | 273/81.4 |
| 2,690,338 | 9/1954 | De Brocke | 273/81.4 |

FOREIGN PATENT DOCUMENTS

| | | | |
|---|---|---|---|
| 8702899 | 5/1987 | WIPO | 273/81.4 |

*Primary Examiner*—Sebastiano Passaniti

[57] ABSTRACT

A golf grip with recesses to insure proper hand positioning of a user comprising a cylindrical body portion fabricated of a elastomeric material with limited resilience, the body portion having an open lower end for positioning over the upper end of a golf shaft, the cylindrical body portion having an upper end, the body portion having a front surface positionable over the head of the golf club and a rear surface on the side opposite from the front surface, the cylindrical body portion having a leading surface facing in the direction of the club face and a trailing surface facing in the direction opposite from the leading surface; a plurality of separate central recesses formed in the central extent of the grip; a plurality of separate recesses formed in the upper extent of the grip; and a plurality of separate lower recesses formed in the lower extent of the grip.

1 Claim, 3 Drawing Sheets

PRIOR ART

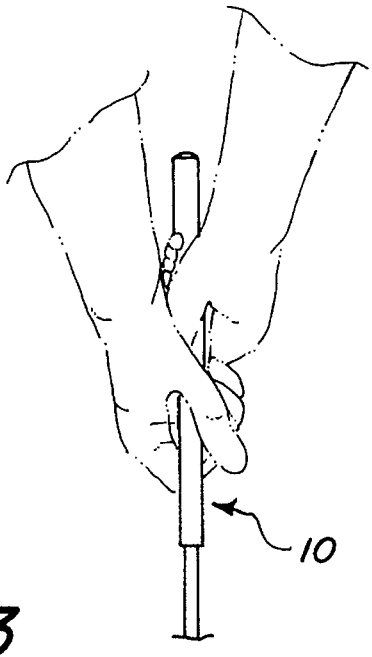
Fig. 3
Fig. 4
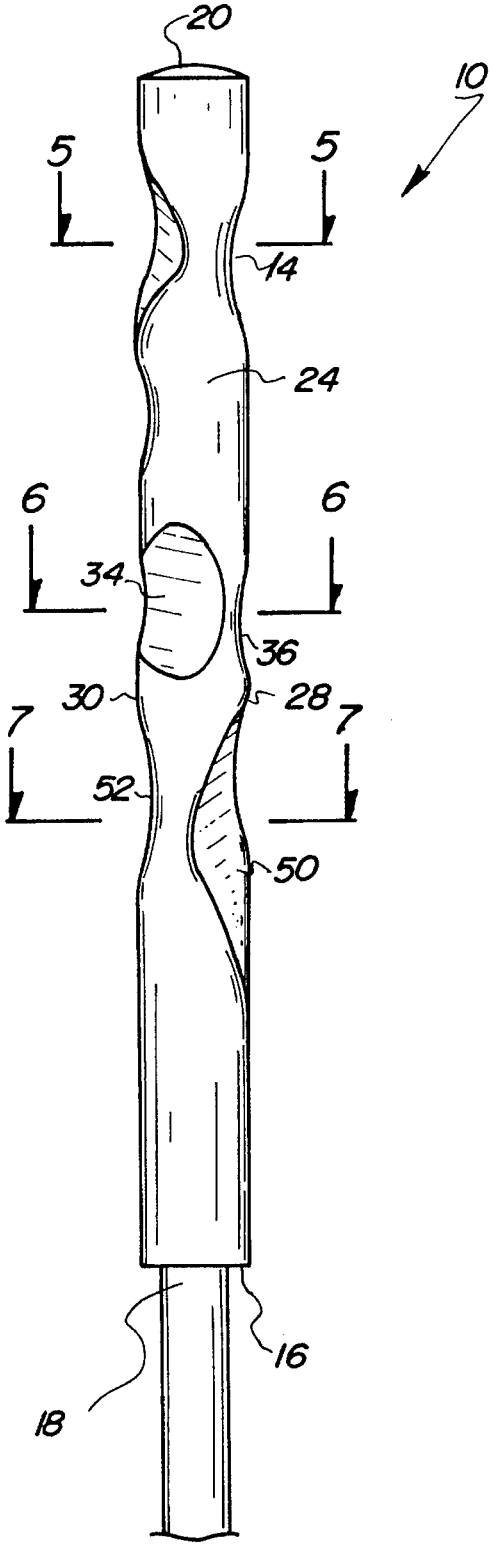

GOLF GRIP WITH RECESSES TO INSURE PROPER HAND POSITIONING OF A USER

BACKGROUND OF THE INVENTION

1. Field of the Invention

The present invention relates to a golf grip with recesses to insure proper hand positioning of a user and more particularly pertains to hitting truer golf shots by requiring proper hand placement over the grip through strategically located recesses.

2. Description of the Prior Art

The use of golfing aids including grips of a wide variety of designs and configurations is known in the prior art. More specifically, golfing aids including grips of a wide variety of designs and configurations heretofore devised and utilized for the purpose of improving one's golfing game through various methods and apparatuses are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 3,606,325 a golf club grip.

U.S. Pat. No. 4,776,595 discloses a golf club grip positioning aid.

U.S. Pat. Des. No. 321,233 discloses the design of a golf club grip.

U.S. Pat. Des. No. 333,333 discloses the design of another golf club grip.

U.S. Pat. Des. No. 334,224 discloses the design of yet another golf club grip.

In this respect, the golf grip with recesses to insure proper hand positioning of a user according to the present invention substantially departs from the conventional concepts and designs of the prior art, and in doing so provides an apparatus primarily developed for the purpose of hitting truer golf shots by requiring proper hand placement over the grip through strategically located recesses.

Therefore, it can be appreciated that there exists a continuing need for a new and improved golf grip with recesses to insure proper hand positioning of a user which can be used to hit truer golf shots by requiring proper hand placement over the grip through strategically located recesses. In this regard, the present invention substantially fulfills this need.

SUMMARY OF THE INVENTION

In view of the foregoing disadvantages inherent in the known types of golfing aids including grips of a wide variety of designs and configurations now present in the prior art, the present invention provides an improved golf grip with recesses to insure proper hand positioning of a user. As such, the general purpose of the present invention, which will be described subsequently in greater detail, is to provide a new and improved golf grip with recesses to insure proper hand positioning of a user and method which has all the advantages of the prior art and none of the disadvantages.

To attain this, the present invention essentially comprises a new and improved golf grip with recesses to insure proper hand positioning of a user comprising, in combination, a cylindrical body portion fabricated of an elastomeric material with limited resilience, the body portion having an open lower end for positioning over the upper end of a golf shaft, the cylindrical body portion having a cap over the upper end for the closure thereof, the body portion having a front surface positionable over the head of the golf club and a rear surface on the side opposite from the front surface, the cylindrical body portion having a leading surface facing in the direction of the club face and a trailing surface facing in the direction opposite from the leading surface; a plurality of central recesses formed in the central extent of the grip, the central recesses including a major recess between the front surface and trailing surface and major recesses on the leading surface and a minor recess between the rear surface and trailing surface; a plurality of upper recesses formed in the upper extent of the grip, the upper recesses including a major recess on the rear surface and leading surface and a major recess on the front surface and trailing surface and a minor recess on the rear surface and trailing surface; and a plurality of lower recesses formed in the lower extent of the grip, the lower recesses including a major recess in the leading surface and front surface and a major recess in the trailing surface.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved golf grip with recesses to insure proper hand positioning of a user which has all the advantages of the prior art golfing aids including grips of a wide variety of designs and configurations and none of the disadvantages.

It is another object of the present invention to provide a new and improved golf grip with recesses to insure proper hand positioning of a user which may be easily and efficiently manufactured and marketed.

It is further object of the present invention to provide a new and improved golf grip with recesses to insure proper hand positioning of a user which is of a durable and reliable construction.

An even further object of the present invention is to provide a new and improved golf grip with recesses to insure proper hand positioning of a user which is susceptible of a low cost of manufacture with regard to both materials and labor, and which accordingly is then susceptible of low prices of sale to the consuming public, thereby making such golf grip with recesses to insure proper hand positioning of a user economically available to the buying public.

Still yet another object of the present invention is to provide a new and improved golf grip with recesses to insure proper hand positioning of a user which provides in the apparatuses and methods of the prior art some of the advantages thereof, while simultaneously overcoming some of the disadvantages normally associated therewith.

Still another object of the present invention is to hit truer golf shots by requiring proper hand placement over the grip through strategically located recesses.

Lastly, it is an object of the present invention to provide a new and improved golf grip with recesses to insure proper hand positioning of a user comprising a cylindrical body portion fabricated of a elastomeric material with limited resilience, the body portion having an open lower end for positioning over the upper end of a golf shaft, the cylindrical body portion having an upper end, the body portion having a front surface positionable over the head of the golf club and a rear surface on the side opposite from the front surface, the cylindrical body portion having a leading surface facing in the direction of the club face and a trailing surface facing in the direction opposite from the leading surface; a plurality of separate central recesses formed in the central extent of the grip; a plurality of separate recesses formed in the upper extent of the grip; and a plurality of separate lower recesses formed in the lower extent of the grip.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a front elevational view of the preferred embodiment of the new and improved golf grip with recesses to insure proper hand positioning of a user constructed in accordance with the principles of the present invention.

FIG. 4 is an enlarged front elevational view of the grip shown in FIG. 3.

The same reference numerals refer to the same parts through the various Figures.

DESCRIPTION OF THE PREFERRED EMBODIMENT

Figure 1:
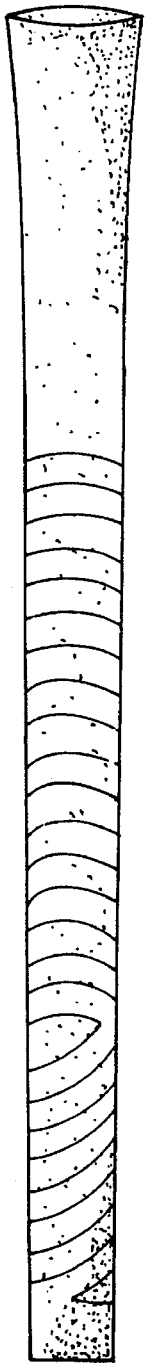
FIG. 1 is a front elevational view of a prior art golf grip with improved hand placement capabilities.
Figure 2:
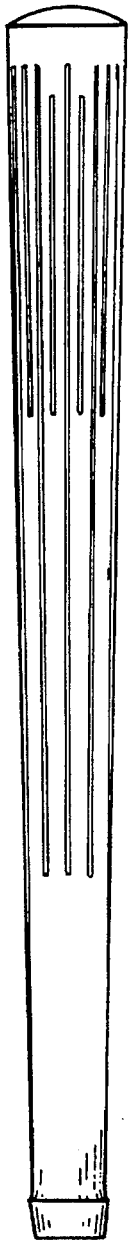
PRIOR ART Fig. 2
FIG. 2 is another type of prior art golf grip for improved hand traction.

With reference now to the drawings, and in particular to FIG. 3 thereof, the preferred embodiment of the new and improved golf grip with recesses to insure proper hand positioning of a user embodying the principles and concepts of the present invention and generally designated by the reference numeral 10 will be described.

The present invention, the new and improved golf grip with recesses to insure proper hand positioning of a user, is comprised of a plurality of components. In their broadest context, the components include a cylindrical body portion fabricated of an elastomeric material with limited resilience, a plurality of central recesses, a plurality of upper recesses and a plurality of lower recesses. Such components are individually configured and correlated with respect to each other so as to attain the desired objective.

The central component of the golf grip 10 of the present invention is a cylindrical body portion 14. Such body portion is fabricated of an elastomeric material with limited resilience. Such body portion may be fabricated with a thin coating over the exterior surface thereof for extended life and improved gripability.

The cylindrical body portion is formed with an open lower end 16. Such is for the removable positioning thereof over the upper end of a golf shaft 18. The cylindrical body portion is also preferably formed with a cap 20 located over the upper end of the body portion for the closure thereof. The body portion has a front surface 24. Such surface is positionable to be located over the head of the golf club when mounted thereon. The body portion also has a rear surface 26 on the side of the body portion opposite from the front surface. Between the front and rear surfaces, the body portion has a leading surface 28. Such surfaces faces the direction of the golf face and the direction of ball travel. Lastly, the cylindrical body portion has a trailing surface 30. Such surface faces in the direction opposite from the leading surface. Insofar as it has been described, the golf grip is essentially conventional. The improvement is in the formation of strategically placed recesses on the exterior surface of the cylindrical body portion to aid the golfer in the proper positioning of hands during use of the golf club provided with the golf grip of the present invention.

Figure 6:
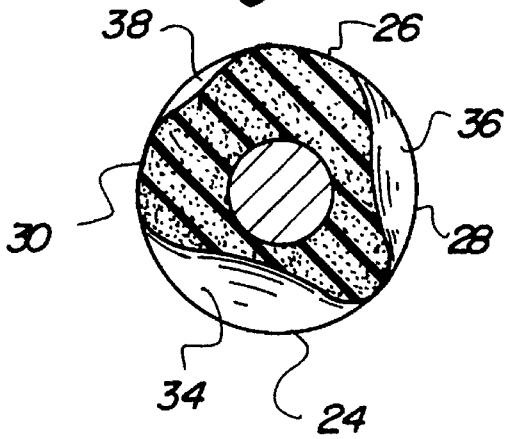
FIG. 6 is a cross-sectional view taken along line 6—6 of FIG. 4.

Formed in the exterior surface of the cylindrical body portion of the golf grip are a plurality of central recesses formed in the central extent of the grip between the upper end and lower end. The central recesses include a major recess 34 which extends between the front surface and trailing surface. Also included is a second major recess 36 on the leading surface. In addition, a minor recess 38 extends between the rear surface and the trailing surface. Note FIGS. 4 and 6.

Figure 5:
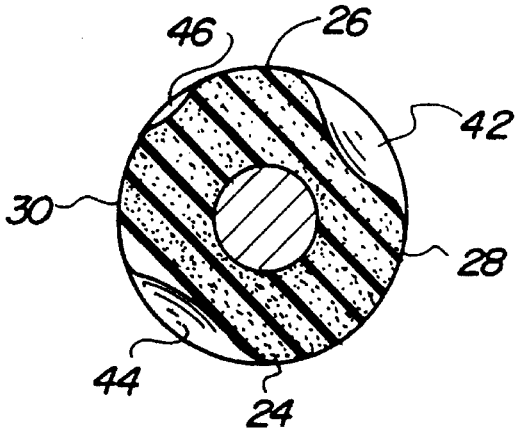
FIG. 5 is a cross-sectional view taken along line 5—5 of FIG. 4.

Next provided are a plurality of upper recesses. Such upper recesses are formed in the upper extent of the grip between the central recesses and the upper end of the grip. The upper recesses include a major recess 42 on the rear surface and leading surface. Also included is a second major recess 44 on the front surface and trailing surface. Note FIGS. 4 and 5. Lastly, a minor recess 46 is located on the rear surface and trailing surface.

Figure 7:
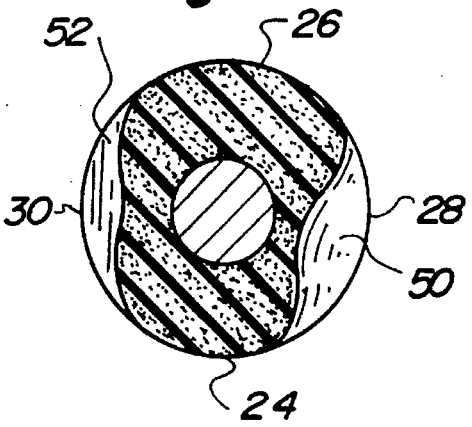
FIG. 7 is a cross-sectional view taken along line 7—7 of FIG. 4.

Lastly provided are a plurality of lower recesses. Such lower recesses are formed in the lower extent of the grip between the central recesses and the lower end of the grip. The lower recesses include a major recess 50 in the leading surface and front surface. A second recess is a major recess 52 formed in the trailing surface. Note FIGS. 4 and 7.

As can be seen, the recesses include three recesses, two major and one minor in the central extent. They also include three recesses, two major and one minor in the upper extent. They also include two recesses, both major, in the lower extent.

The present invention comprises a golf club grip which positions the hands in the ideal and accepted manner for swinging a club correctly to strike the golf ball.

The grips of the present invention are similar to those used on all golf clubs. However, in place of the conventional symmetrical round tapered external surface, it has contours and indentations. These indentations place the fingers so the club is held in a manner which is exactly as that recommended and used by outstanding professionals. The grips are made of synthetic rubber compounds with the contours incorporated into the mold. Since the same grip is used on all of the clubs, only one mold is needed.

It is almost universally accepted that a specific grip should be used to hold a golf club. With plain grips, each golfer assumes what they believe is that grip. Often the gripping is flawed, and the fingers are not in the ideal position. By carefully attaching the contoured grips in relation to the club head, there is nothing left to assume, and the clubs are griped correctly. The contours also help to prevent the clubs from slipping in the hands.

Avid golfers cause a considerable amount of wear of golf club grips, so they are often replaced yearly. When these grips are installed, they will eliminate one of the many variable which give golfers headaches.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A golf grip with recesses to insure proper hand positioning of a user comprising, in combination:

a cylindrical body portion fabricated of an elastomeric material with limited resilience, the body portion having an open lower end for positioning over the upper end of a golf shaft, the cylindrical body portion having a cap over the upper end for the closure thereof, the body portion having a front surface positionable over the head of the golf club when the grip is positioned on a golf club and the golf club is held for use and a rear surface on the side opposite from the front surface, the cylindrical body portion having a leading surface facing in the direction of the club face and a trailing surface facing in the direction opposite from the leading surface;

three separate and circumferentially spaced central recesses formed in the central extent of the grip, the central recesses including a major recess between the front surface and trailing surface and major recesses on the leading surface and a minor recess between the rear surface and trailing surface;

three separate and circumferentially spaced upper recesses formed in the upper extent of the grip, the upper recesses including a major recess on the rear surface and leading surface and a major recess on the front surface and trailing surface and a minor recess on the rear surface and trailing surface; and two separate and circumferentially spaced lower recesses formed in the lower extent of the grip, the lower recesses including a major recess in the leading surface and front surface and a major recess in the trailing surface.

* * * * *